US010410790B2

(12) United States Patent
Yanagi et al.

(10) Patent No.: US 10,410,790 B2
(45) Date of Patent: Sep. 10, 2019

(54) IGNITION COIL FOR INTERNAL COMBUSTION ENGINE

(71) Applicant: Mitsubishi Electric Corporation, Tokyo (JP)

(72) Inventors: Shota Yanagi, Tokyo (JP); Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 122 days.

(21) Appl. No.: 15/572,186

(22) PCT Filed: May 13, 2015

(86) PCT No.: PCT/JP2015/063721
§ 371 (c)(1),
(2) Date: Nov. 7, 2017

(87) PCT Pub. No.: WO2016/181517
PCT Pub. Date: Nov. 17, 2016

(65) Prior Publication Data

US 2018/0151292 A1 May 31, 2018

(51) Int. Cl.
*H01F 38/12* (2006.01)
*H01F 27/32* (2006.01)
*H01F 30/10* (2006.01)

(52) U.S. Cl.
CPC ..... *H01F 38/12* (2013.01); *H01F 27/325* (2013.01); *H01F 30/10* (2013.01); *H01F 2038/122* (2013.01)

(58) Field of Classification Search
CPC .. H01F 38/12; H01F 2038/122; H01F 27/325; H01F 30/10
USPC ..... 336/90, 92, 96, 98, 196, 198, 208; 123/621, 622, 634, 635
See application file for complete search history.

(56) References Cited

U.S. PATENT DOCUMENTS 4,238,753 A * 12/1980 Bayer ..... H01F 5/04 336/178
4,388,568 A * 6/1983 Goseberg ..... H01F 38/42 315/411
8,624,698 B2 * 1/2014 Kim ..... H01F 27/2823 336/192
2002/0014940 A1 2/2002 Kondo et al.
2002/0067233 A1 6/2002 Kondo et al.
(Continued)

FOREIGN PATENT DOCUMENTS

JP 1-274410 A 11/1989
JP 7-130559 A 5/1995
JP 2000-100641 A 4/2000

OTHER PUBLICATIONS

International Search Report for PCT/JP2015/063721 dated Jul. 28, 2015 [PCT/ISA/210].

*Primary Examiner* — Tszfung J Chan
(74) *Attorney, Agent, or Firm* — Sughrue Mion, PLLC; Richard C. Turner

(57) ABSTRACT

A primary coil which includes a primary winding which is wound around a primary bobbin, and a secondary coil which includes a secondary winding which is separately wound around a secondary bobbin which includes a plurality of sections, are provided, and a winding portion of the secondary coil is configured in a state where a maximum winding height is set as 20% through 30% with respect to an axis length winding length.

4 Claims, 7 Drawing Sheets

(56) References Cited

U.S. PATENT DOCUMENTS

| | | | | |
|---|---|---|---|---|
| 2003/0184424 | A1 | 10/2003 | Kondo et al. | |
| 2004/0231652 | A1 | 11/2004 | Kondo et al. | |
| 2009/0277433 | A1* | 11/2009 | Ward ..... | F02P 3/02<br>123/634 |

* cited by examiner

IGNITION COIL FOR INTERNAL COMBUSTION ENGINE

CROSS REFERENCE TO RELATED APPLICATIONS

This application is a National Stage of International Application No. PCT/JP2015/063721, filed on May 13, 2015, the contents of all of which are incorporated herein by reference in their entirety.

TECHNICAL FIELD

The present invention relates to an ignition coil which is mainly attached to a vehicular internal combustion engine, for example, an internal combustion engine of a car, and supplies a high voltage to an ignition plug so as to generate a spark electrical discharge.

BACKGROUND ART

In a conventional art, there has been a requirement in which a burning characteristic is focused, and an ignition coil, which has a high output and high energy, is realized. When an energy specification is satisfied, a sufficient output voltage is outputted, so that there are only ignition coils in which a high voltage of an output voltage is realized by increasing energy, and it has been not considered that how a high voltage is outputted by using identical output energy. In a conventional art, a technology, which is related to a bobbin shape or a winding number distribution, is mainly described as a technology which is related to a high withstand voltage of a secondary coil (for example, refer to Patent Document 1, Patent Document 2, and Patent Document 3).

CONVENTIONAL ART DOCUMENT

Patent Document

Patent Document 1: Japanese Laid-Open Patent Publication No. H01-274410

Patent Document 2: Japanese Laid-Open Patent Publication No. H07-130559

Patent Document 3: Japanese Laid-Open Patent Publication No. 2000-100641

SUMMARY OF THE INVENTION

Problems to be Solved by the Invention

In recent years, in order to improve fuel economy, a downsizing turbo vehicle and a high compression engine are developed. A voltage (insulation breakdown voltage=required voltage), by which an insulation breakdown is performed, is increased between plugs while a high compression is realized, so that it is required an output voltage of an ignition coil is also increased.

It is required in an ignition coil while a required voltage is increased that a high output voltage is realized and a high withstand voltage is realized. On the other hand, there are many cases in which an auxiliary machine, such as a cylinder nonoperational actuator, is attached to an engine in recent years, and attachment space, which is provided to the ignition coil, is decreased, so that it is also required that, the ignition coil is downsized.

An output voltage of the ignition coil is increased while output energy of the ignition coil is increased, and when a capacitance to the ground in a secondary coil and a capacitance of high voltage portions (a spring and an ignition plug) are increased, the output voltage is decreased. Therefore, in order to realize a high output voltage, it is required for the ignition coil that high energy is realized in a conventional ignition coil and a capacitance to the ground in the secondary coil is decreased. Moreover, in order to realize a high withstand voltage of the ignition coil, it is also one of important elements that a capacitance between sections of the secondary coil is decreased.

The present invention has been made to solve the above-described problems, and an object of the invention is to realize an ignition coil, which has a low capacitance and a high withstand voltage, without upsizing the ignition coil.

Means for Solving Problems

An ignition coil for an internal combustion engine, of the present invention includes a primary coil which includes a primary winding which is wound around a primary bobbin; a secondary coil which is arranged at an outer circumference of the primary coil, and includes a secondary winding which is separately wound around a secondary bobbin which is coaxially arranged with respect to the primary coil and includes a plurality of sections, and supplies a high voltage to an ignition plug in accordance with energization operation or a breaking operation of a primary electric current which is flowed to the primary winding; an iron core by which the primary coil and the secondary coil are magnetically linked; and an insulating case in which the primary coil, the secondary coil, and the iron core are installed; wherein a winding portion of the secondary coil is configured in a state where a maximum winding height is set as 20% through 30% with respect to an axis length winding length.

Effects of the Invention

According to the ignition coil of the present invention, a winding portion of a secondary coil is configured in a state where a maximum winding height is set as 20% through 30% with respect to an axis length winding length, whereby capacitances to the ground of the secondary coil is suppressed, and a high output voltage can be obtained, and capacitances between sections of the secondary coil are decreased, so that the secondary coil, which has a high withstand voltage, can be obtained, and an ignition coil, which has a small size, a high output voltage, and a high withstand voltage, can be obtained.

MODE FOR CARRYING OUT THE INVENTION

Embodiment 1

Figure 1:
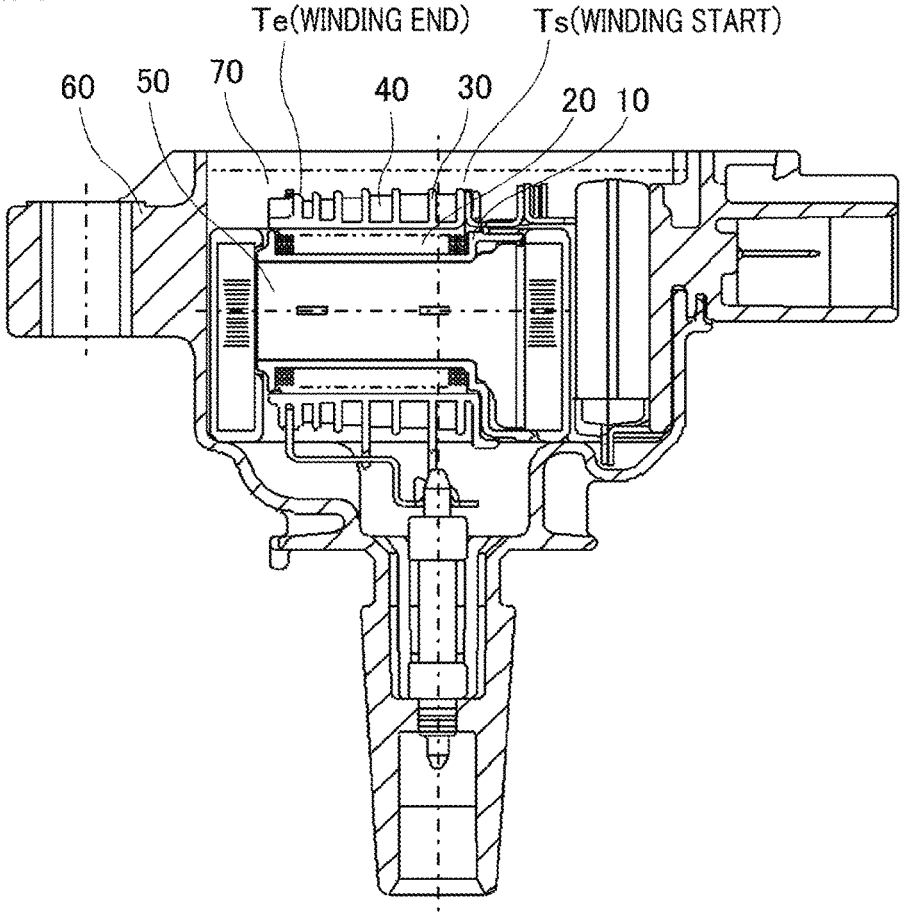
FIG. 1 is a cross-sectional view which indicates an ignition coil according to Embodiment 1 of the present invention.

FIG. 1 is a cross-sectional view which indicates a schematic configuration of an ignition coil according to Embodiment 1 of the present invention. As indicated in FIG. 1, a primary coil, which includes a primary winding 20 which is wound around a primary bobbin 10, is provided in the ignition coil. At an outer circumference of the primary coil, a secondary coil, which includes a secondary winding 40 which supplies a high voltage to an ignition plug in accordance with an energization operation or a breaking operation of a primary electric current which is flowed to the primary winding 20, and is separately wound around a secondary bobbin 30 which is coaxially arranged with respect to the primary coil and includes a plurality of sections, and indicates a distribution in which a high voltage is realized while a winding number is increased from a winding start to a winding end when the secondary winding 40 is energize, is arranged. The primary coil and the secondary coil are magnetically linked by using an iron core 50. Moreover, these configuration components are installed in an insulating case 60, and are inserted and formed by using an insulating resin 70.

Figure 2:
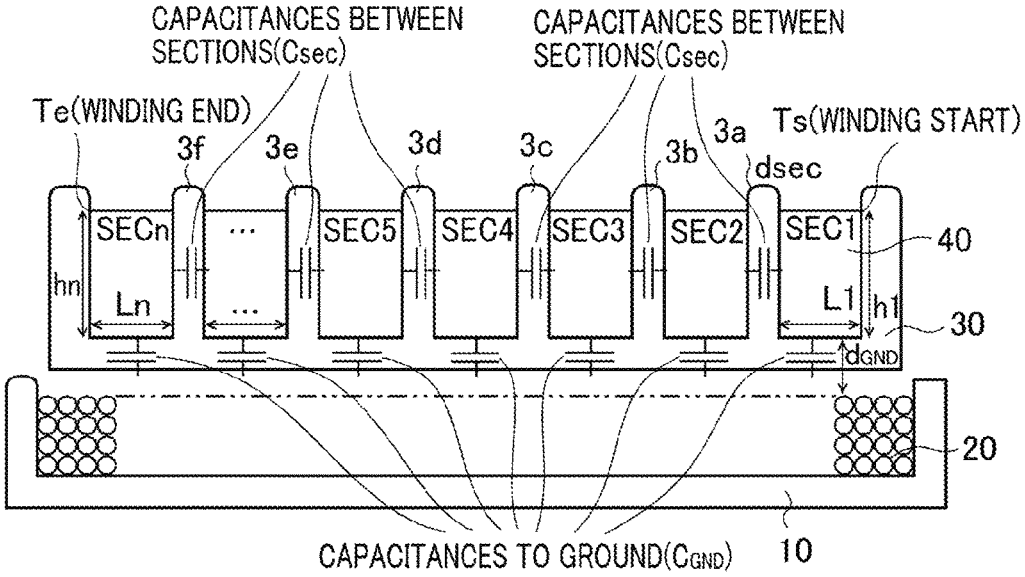
FIG. 2 is a view which indicates an image of capacitances between sections and capacitances to the ground in the ignition coil according to Embodiment 1 of the present invention.

Firstly, capacitances to the ground and capacitances between sections of the ignition coil will be explained. A schematic view of the secondary coil and the primary coil, and an image of the capacitances ($C_{sec}$) between the sections and the capacitances ($C_{GND}$) to the ground are indicated in FIG. 2. A capacitance of a capacitor is represented by Formula (1).

$$C=\varepsilon\times S/d \qquad \text{Formula (1)}$$

In this case, "S" represents an area of an electrode plate, and "d" represents a distance between electrode plates, and "ε" represents a dielectric constant of a dielectric between the electrode plates.

Therefore, the capacitances to the ground can be represented as Formula (2).

$$C_{GND}\propto Li/d_{GND} \qquad \text{Formula (2)}$$

The capacitances between the sections can be represented as Formula (3).

$$C_{sec}\propto hi/d_{sec} \qquad \text{Formula (3)}$$

Li; an axis length winding length of an ith section
hi; a winding height of the ith section
(ε and a depth of a winding are constant)
$d_{GND}$; a distance to GND and a primary winding
$d_{sec}$; a thickness of a wall between the sections In the following description, a relation between an output voltage and a configuration for a withstand voltage will be described.

When a relation between energy and a capacitance and a voltage, which is applied to the capacitance, is used, the relation between the output voltage and the configuration is represented as Formula (4) in accordance with "E="$C\times V_2^2/2$", so that the output voltage is decreased when the capacitances $C_{GND}$ to the ground are increased.

[Number 1]

$$V_2=\sqrt{(2E/C)} \qquad \text{Formula (4)}$$

E: output energy of an ignition coil
$V_2$: an output voltage
C: $C_{GND}+C_{ext}$, $C_{ext}$: an outside capacitance of an engine, a plug and the like In order to increase the output voltage, it is required that the output energy of the ignition coil is increased, and the outside capacitance C is decreased in accordance with Formula (4). When the output energy of the ignition coil is increased, the ignition coil is upsized, so that in order to increase the output voltage without upsizing the ignition coil in accordance with Formula (2), it is suitable that the section axis length winding length Li is decreased or the distance $d_{GND}$ is increased.

A required winding cross-sectional area of the secondary coil is determined in accordance with an output requirement of the ignition coil, and a summation of a winding cross-sectional area of each of the sections of the secondary coil is constant, so that there is a relation of Formula (5) between the winding height hi and the section axis length winding length Li. Therefore, when the section axis length winding length Li is decreased, the winding height hi is increased.

[Number 2]

$$\Sigma_{1=1\ to\ n}Li\times hi=K\ (K \text{ is constant}) \qquad \text{Formula (5)}$$

Hereinafter, a relation between a withstand voltage and a configuration will be explained. When an output voltage is defined as V, and a total winding number is defined as N, a voltage $V_{N1}$, which is applied with respect to a winding number 1T, is represented as Formula (6) ((Vn) represents a voltage which is applied to a nth winding).

$$V_{N1}=dV(n)/dn \qquad \text{Formula (6)}$$

In this case, when a winding number in an axis direction with respect to an ith section is defined as $n_w i$, an electric potential difference $V_{layer}$ between layers is represented as Formula (7).

$$V_{layer} \propto V_{N1} \times n_w i \quad \text{Formula (7)}$$

In a similar way, when a winding number of some section is defined as ni (i is a section number), electric potential differences Vsec between sections are represented as Formula (8).

$$V\text{sec} = V_{N1} \times ni \quad \text{Formula (8)}$$

In order to decrease the electric potential difference $V_{layer}$ between the layers in accordance with Formula (7), it is required that a voltage $V_{N1}$ and a winding number $n_{w1}$ are decreased, and in order to decrease the electric potential differences $V_{sec}$ between the sections in accordance with Formula (8), it is required that the voltage $V_{N1}$ and the winding number ni are decreased.

There is a relation of the following Formula (9) between the winding number $n_w i$ and the section axis length winding length Li, and in order to decrease the winding number $n_w i$, it is required that the section axis length winding length Li is decreased.

$$n_w i \times \varphi = Li \quad \text{Formula (9)}$$

φ: a diameter of a secondary winding

Figure 3:
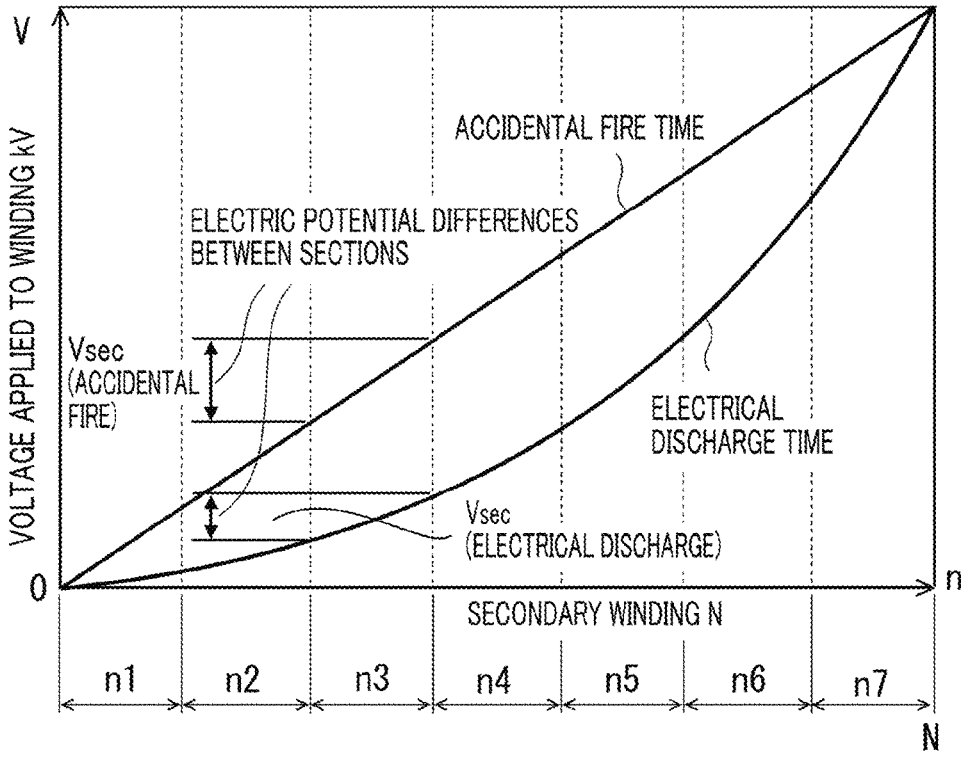
FIG. 3 is a characteristic view which indicates an electric potential distribution of a secondary winding at an electrical discharge time and an accidental fire time in the ignition coil according to Embodiment 1 of the present invention.
Figure 4:
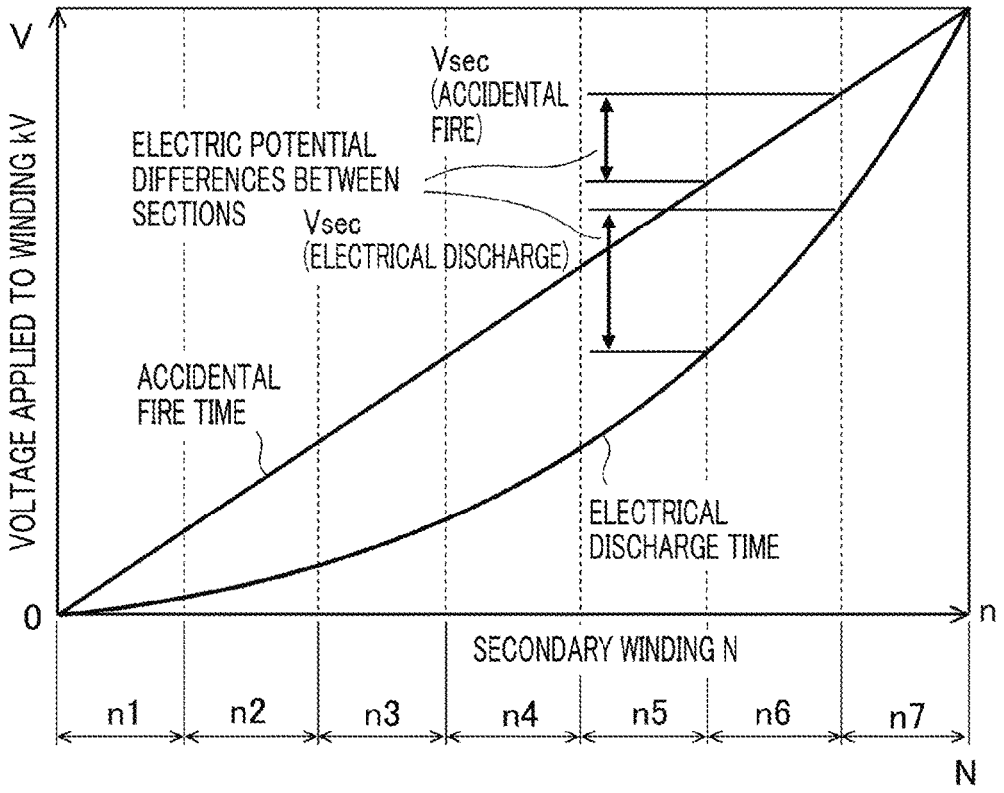
FIG. 4 is a characteristic view which indicates an electric potential distribution of the secondary winding at an electrical discharge time and an accidental fire time in the ignition coil according to Embodiment 1 of the present invention.

In order to explain the voltage $V_{N1}$, the electric potential distributions of the secondary coil at an ignition coil operation time will be minutely explained. The electric potential distributions of the secondary winding at an electrical discharge time and an accidental fire time are indicated in FIG. 3 and FIG. 4. A vertical axis indicates a voltage, and a horizontal axis indicates a winding number. A voltage, which is distributed by each of the sections, is corresponding to a section number and a winding number per a section. It is recognized that tendencies of voltages, which are applied with respect to a winding, are different at an electrical discharge time and an accidental fire time. When a winding number of some section is defined as a ni (i is a section number), the electric potential differences Vsec between the sections are represented as Formula (10), and in order to decrease the electric potential differences Vsec between the sections, it is required that the voltage $V_{N1}$ is decreased, and the winding number ni is reduced.

$$V\text{sec} = V_{N1} \times ni \quad \text{Formula (10)}$$

Figure 5:
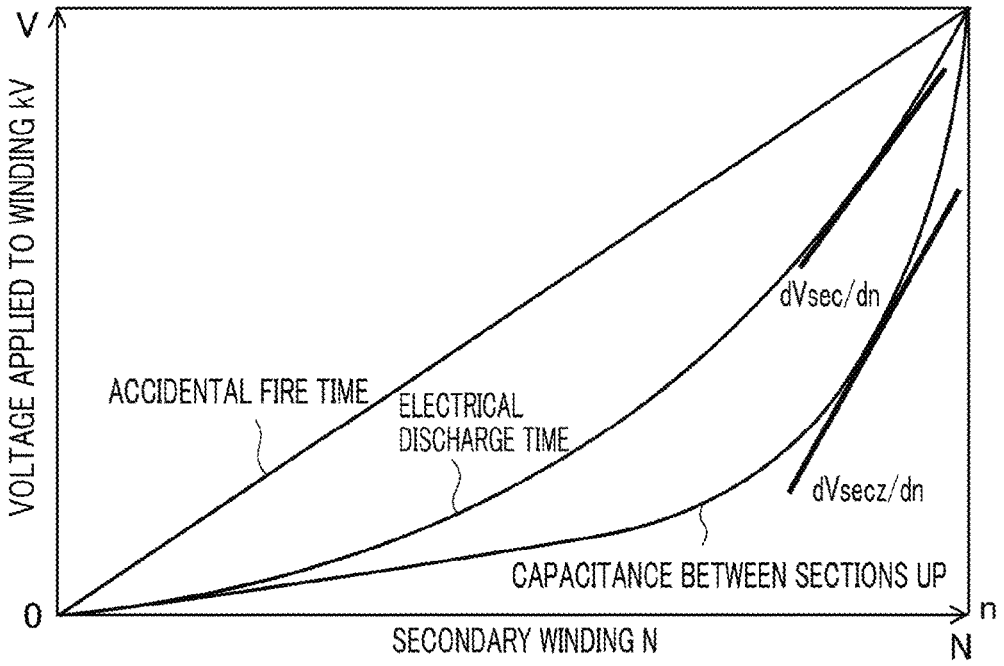
FIG. 5 is a characteristic view which indicates an electric potential distribution of the secondary winding when the capacitances between the sections are increased in the ignition coil according to Embodiment 1 of the present invention.

As indicated in FIG. 3, at a low voltage portion of a winding start of the secondary coil, it is represented that "Vsec (accidental fire)>Vsec (electrical discharge)", so that a withstand voltage at an accidental fire time is severe, and as indicated in FIG. 4, at a high voltage portion which is closed to a winding end, it is represented that "Vsec (electrical discharge)>Vsec (accidental fire)", so that a withstand voltage at an electrical discharge time is severe. Moreover, when dVsec/dn, in a case where a capacitance between the sections is decreased, is compared with dVsecz/dn, in a case where a capacitance between the sections is increased, it is represented that "dVsecz/dn>dVsec/dn" as indicated in FIG. 5, so that a voltage, which is applied to a high voltage section at an electrical discharge time, is more inclined.

As described above, in order to decrease Vsec, it is recognized that the capacitance between the sections is required to be decreased. In order to decrease the capacitance between the sections, it is suitable that the winding height hi is decreased in accordance with Formula (3), or a thickness $d_{sec}$, of a wall between the sections is thickened. When the thickness $d_{sec}$ of the wall between the sections is thickened, the ignition coil is upsized. However, when the winding height hi is decreased in accordance with Formula (5), it is required that the section axis length winding length Li is increased.

Figure 6:
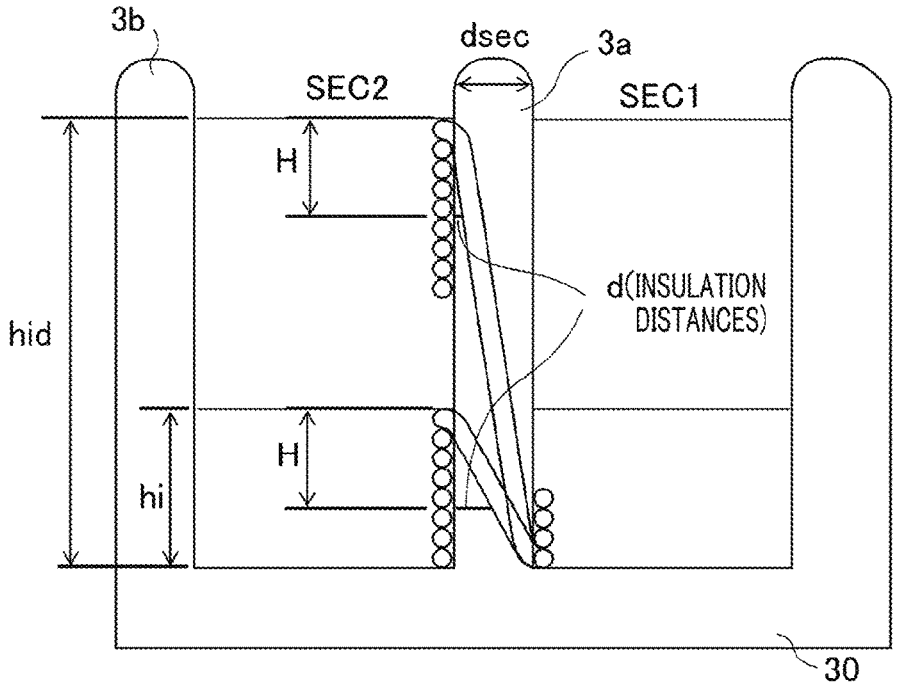
FIG. 6 is a view which indicates a relation of insulation distances to a crossing wire when a winding height is increased in the ignition coil according to Embodiment 1 of the present invention.

Moreover, when the winding height hi is increased, as indicated in FIG. 6, insulation distances between a crossing wire and a winding, which is wound around a section, at an arbitrary height H from a winding top step are represented as Formula (11) when the thicknesses of the walls between the sections are identical.

$$H \times \tan\theta_1 > H \times \tan\theta_2 \quad \text{Formula (11)}$$

In this case, when the insulation distances are set in a relation of the following Formula (12), the insulation distances can be represented as Formula (13), and when the winding height hi is increased in accordance with Formula (13), the insulation distances are shortened, so that a withstand voltage is decreased.

[Number 3]

$$\tan\theta 1 \approx d\text{sec}/hi,\ \tan\theta 2 \approx d\text{sec}/hid,\ hi > hid \quad \text{Formula (12)}$$

$$H_{2T} \times d\text{sec}/hi > H_{2T} \times d\text{sec}/hid \quad \text{Formula (13)}$$

As described above, when a coil, which has a small size, a high voltage output, and a high withstand voltage, is designed, the axis length winding length L and the winding height $h_{max}$ have a trade-off relation with respect to the output voltage and the withstand voltage.

Figure 8:
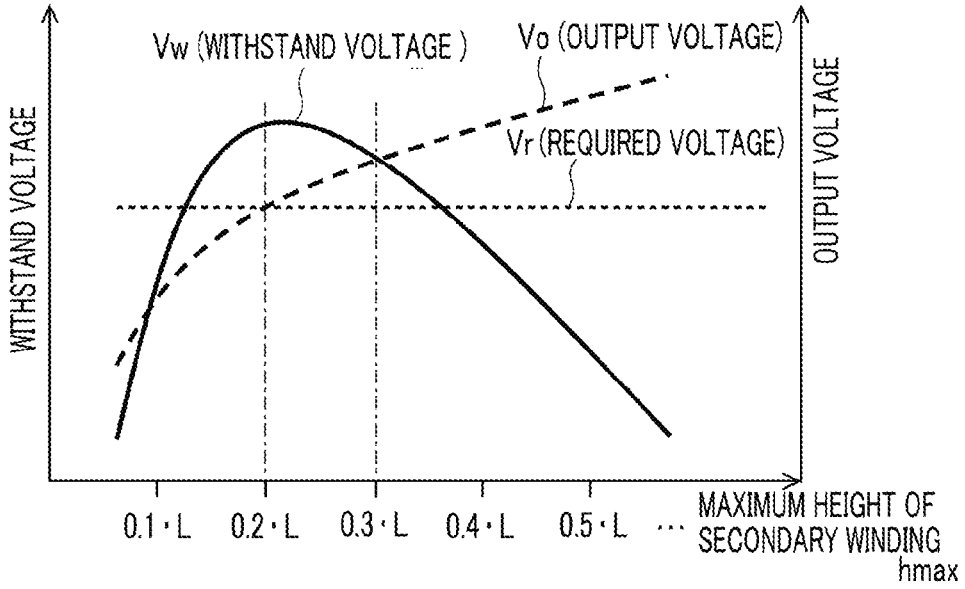
FIG. 8 is a characteristic view which indicates a relation between an output voltage of the ignition coil and a withstand voltage in the ignition coil according to Embodiment 1 of the present invention.

In this case, when relations between the output voltage of the ignition coil and the withstand voltage are integrated, the relations are indicated as FIG. 8.

Vertical axes in FIG. 8 indicate the output voltage and the withstand voltage, and a horizontal axis indicates a maximum winding height.

The output of the ignition coil is recognized in accordance with Formula (2) and Formula (4), so that an output voltage Vo (dashed line) of the ignition coil is increased as indicated in FIG. 8 while the axis length winding length L is decreased.

Moreover, when the maximum winding height $h_{max}$ is increased, the axis length winding length L is decreased in accordance with Formula (5), and $n_w i$ is decreased in accordance with Formula (8), so that the withstand voltage of the ignition coil is gradually increased, and a maximum value of the withstand voltage is realized at a position near "$h_{max}$=0.2 L". After that, when the maximum winding height $h_{max}$ is continuously increased, $C_{sec}$ is increased in accordance with Formula (3), so that the withstand voltage is gradually decreased, and a withstand voltage Vw (solid line) is lower than the output voltage Vo at a position near "$h_{max}$=0.3 L" as indicated in FIG. 8.

Moreover, Vr (dotted line), which is indicated in FIG. 8, indicates a required voltage of an engine. In order to realize a capability for the ignition coil, it is required that the withstand voltage Vw exceeds the output voltage Vo, and the output voltage Vo exceeds the required voltage Vr, of the engine. When the section number is increased, a straight line of the withstand voltage is shifted in an upper direction. When the required voltage Vr is increased, a flexibility of a design for the secondary coil is reduced.

Therefore, as explained above, in order to satisfy the withstand voltage and the output voltage in just proportion, it is required that the maximum winding height $h_{max}$ of the secondary winding is set as "$h_{max}$=0.2 L through 0.3 L".

Figure 7:
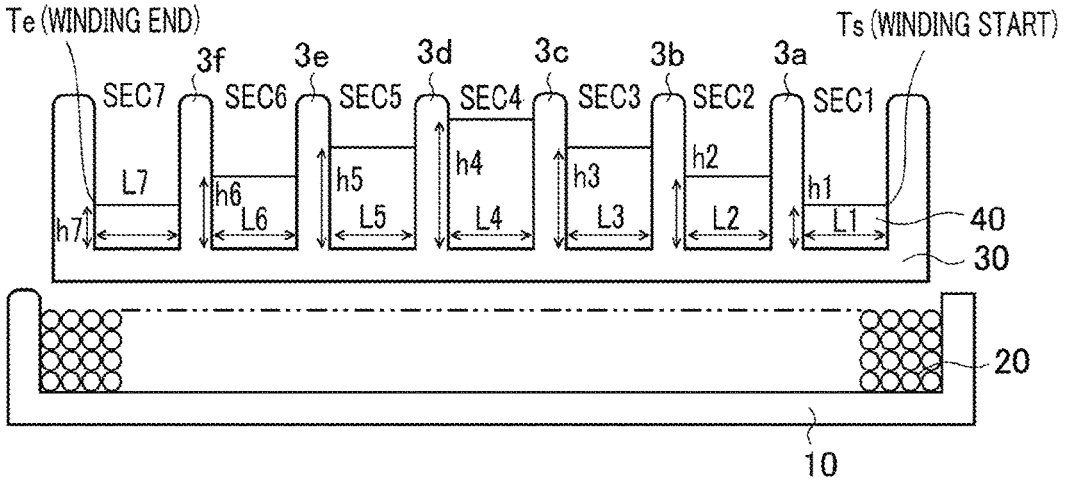
FIG. 7 is a view which indicates an image of an axis length winding length and a maximum winding height in the ignition coil according to Embodiment 1 of the present invention.

In the ignition coil according to Embodiment 1, the maximum winding height $h_{max}$ (a section, at which the maximum winding height is $h_{max}$, may be an arbitrary section) is set as 20% through 30% with respect to the axis length winding length L (L is a summation of the axis length winding length Li of each of the sections) in the winding portion of the secondary coil. The image of the axis length winding length L and the maximum winding height $h_{max}$ are represented in FIG. 7.

The secondary bobbin 30 is separated by using a wall 3*a* through a wall 3*f*, and seven sections, which are composed of a first section SEC1 through a seventh section SEC7, are provided. In FIG. 7, the maximum winding height $h_{max}$ is indicated as a winding height hi at a fourth section SEC4.

Embodiment 2

Figure 9:
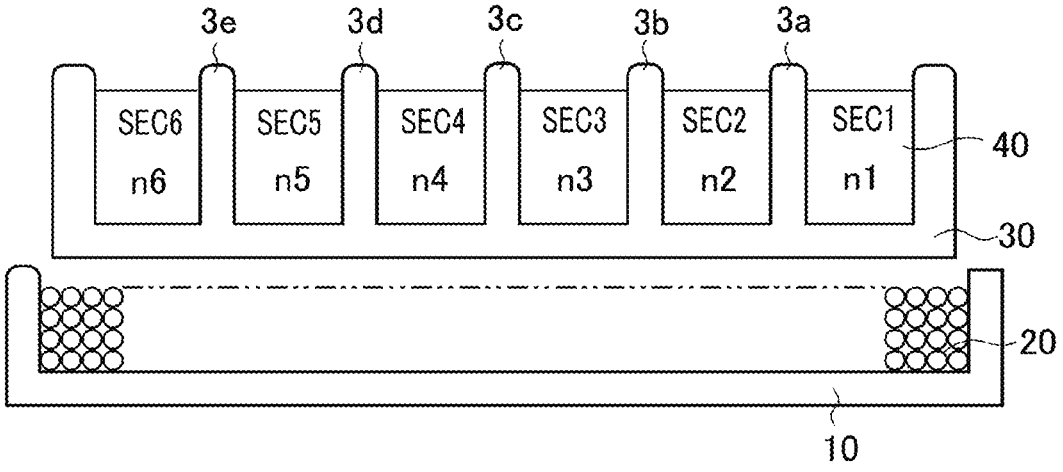
FIG. 9 is a cross-sectional view which indicates an ignition coil according to Embodiment 2 of the present invention.

FIG. 9 indicates a main portion of an ignition coil according to Embodiment 2, and it is different from the ignition coil according to Embodiment 1 that a section number of a secondary coil is 6 sections.

When the section number is 6 sections, the number of walls of sections is decreased, so that it is recognized that a ratio of a winding of the secondary coil is increased. Moreover, when the number of the sections is decreased, capacitances between the sections can be decreased, and a minimum necessary amount of a withstand voltage can be secured, so that when the section number of the secondary coil is lower than equal to 6 sections, the ignition coil can be formed in a minimum shape.

Embodiment 3

Figure 10:
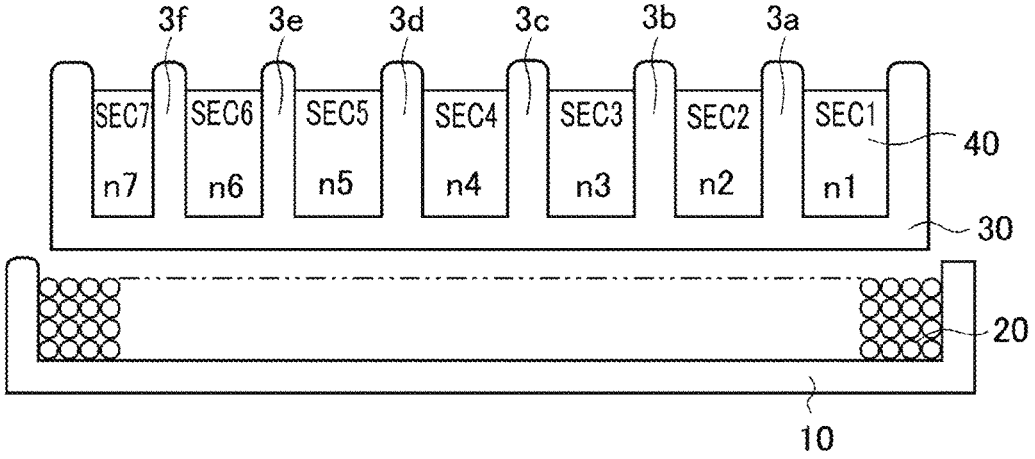
FIG. 10 is a cross-sectional view which indicates an ignition coil according to Embodiment 3 of the present invention.

FIG. 10 indicates a main portion of an ignition coil according to Embodiment 3, and it is different from the ignition coil according to Embodiment 1 that electric potential differences between sections are increased at the sections at which many windings are performed, so that thicknesses of walls between the sections are increased in order to secure an insulation distance.

In this case, when a secondary winding of some section is considered, a winding operation is firstly and sequentially performed in a winding axis direction from a section end surface at a winding start side of a lowest layer at a primary coil side, and the winding operation is shifted to a second step from a bottom, which is higher with one step, when the winding operation reaches an end surface at an opposite side, and next, a winding operation is sequentially performed in an axis direction and in a reverse direction with respect to a lowest step. In other words, a winding operation is performed in a zigzag shape from a lowest step in accordance with each of sections. Moreover, there is a wall between the sections at which a secondary winding, which is separately wound, is arranged, and a winding at the inside of one section and a winding at the inside of an adjacent section are linked by using a crossing wire which is disposed at a passage which is provide at the wall. As described above, when the winding operation of the coil is performed, the winding operation is performed in a zigzag shape from a lowest step to a highest step, so that the crossing wire connects a winding at a highest step of one section and a winding at a lowest step in an inclined direction with respect to an axis direction. In this case, while a winding number per a section is increased, an electric potential difference between each of the lowest steps (between the sections) is increased in accordance with Formula (8), so that it is required that a thickness of the wall between the sections is increased.

In FIG. 10, winding numbers of each of the sections are set as n1, n2, n3, n4, n5, n6, and n7, and a relation between each of the winding numbers is represented as "n1>n2>n3>n4>n5>n6>n7". Moreover, when thicknesses of each of wall 3*a* through wall 3*f* are set as 3*a*, 3*b*, 3*c*, 3*d*, 3*e*, and 3*f* for convenience sake, a relation of "3*a*>3*b*>3*c*>3*d*>3*e*>3*f*" is represented between the walls. In other words, there is a characteristic in which a wall between the sections, in which many windings of a secondary coil are included, is thicker than a wall between the sections, in which few windings of the secondary coil are included.

As described above, only a thickness of the wall between the sections, in which many windings are included, is increased, whereby upsizing, which is not required, can be avoided, and a withstand voltage between the sections can be increased.

As described above, when the thickness of the wall between the sections, in which many windings are included in the secondary coil, is increased, a distance of only a section, which has a large capacitance, is expanded, so that the upsizing, which is not required, can be avoided, and a capacitance between the sections can be suppressed. Although a withstand voltage between the sections is severe at the sections in which many windings are included, the thickness of the wall between the sections is increased, whereby the withstand voltage between the sections can be increased.

Embodiment 4

Figure 11:
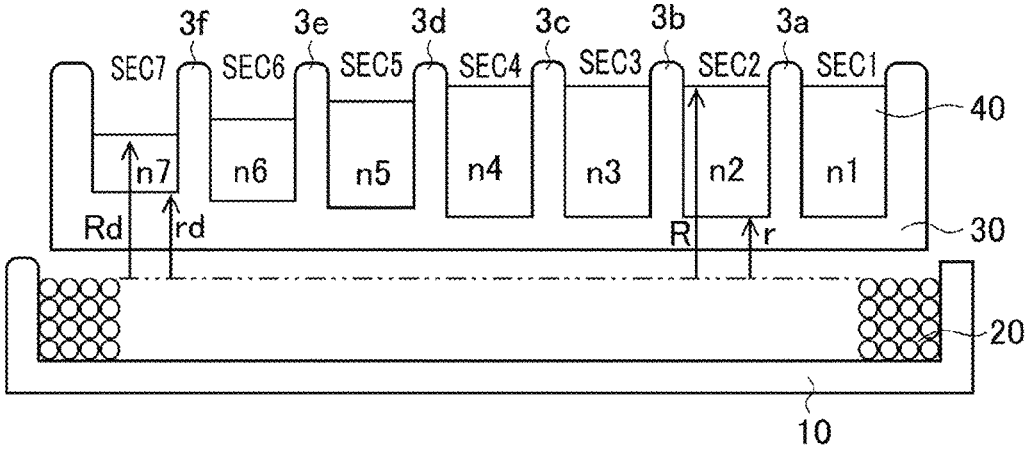
FIG. 11 is a cross-sectional view which indicates an ignition coil according to Embodiment 4 of the present invention.

FIG. 11 indicates a main portion of an ignition coil according to Embodiment 4, and it is different from the ignition coil according to Embodiment 1 that a distance rd between a secondary winding and a primary winding at a later half of sections of a secondary coil is greater than a distance r at a first half of the sections (rd>r), and a distance Rd from the primary winding to a top step of the secondary winding at a later half of the sections of the secondary coil is smaller than a distance R at a first half of the sections (Rd<R). In other words, at a section at a winding end side of the secondary coil, an internal diameter of the secondary winding is large and an outside shape is small in comparison with a section at a winding start side. Thereby, a wide insulation distance to the other components can be secured, and winding space of the secondary coil can be secured at a winding start side (a low voltage side), so that it can be prevented that the ignition coil is capsized, and a withstand voltage can be secured.

As described above, the internal diameter of the secondary winding is large and the outside shape is small at a high voltage section of the secondary coil, whereby a winding number is secured at a low voltage portion, and a distance to the other component, for example, a primary coil can be secured at a high voltage portion, so that it can be prevented that the ignition coil is upsized, and the withstand voltage can be secured (maintained).

Embodiment 5

Figure 12:
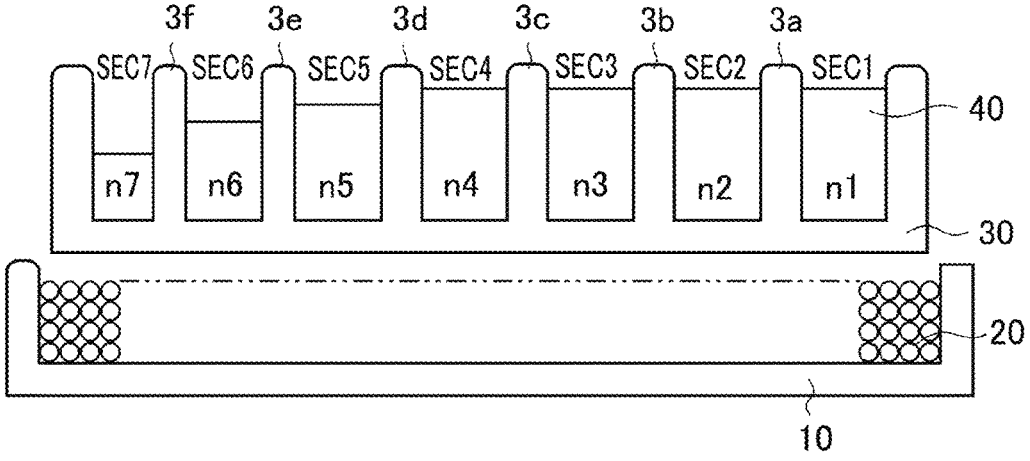
FIG. 12 is a cross-sectional view which indicates an ignition coil according to Embodiment 5 of the present invention.

FIG. 12 indicates a main portion of an ignition coil according to Embodiment 5, and it is different from the ignition coil according to Embodiment 1 that a winding number per a section of a secondary coil is decreased while a winding is closed to a section which is near to a winding end. In other words, a winding number per a section of the secondary coil at a section at a winding end side is decreased in comparison with a section at a winding start side.

Figure 13:
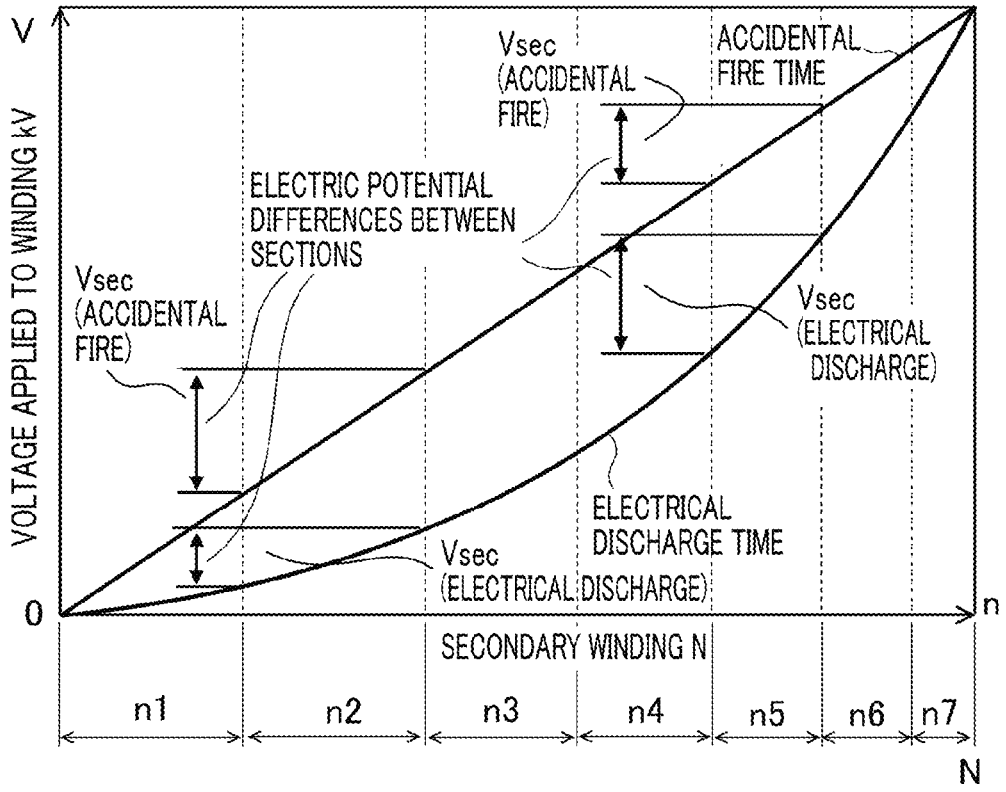
FIG. 13 is a characteristic view which indicates electric potential differences between sections of the ignition coil in the ignition coil according to Embodiment 5 of the present invention.

As indicated in FIG. 13, a winding number is increased at a low voltage section at a winding start, and a winding number is decreased toward a high voltage section at a winding end, whereby Vsec (accidental fire) of a low voltage portion at the winding start is roughly identical to Vsec (electrical discharge) of a high voltage portion which is near to the winding end, and electric potential differences between the sections can be closed to a uniform electric potential difference.

When a winding number ni is decreased in accordance with Formula (8), although a voltage $V_{N1}$ is decreased, and when the winding number ni is decreased at all sections, a total winding number N of the secondary coil is decreased. Therefore, a winding number is increased at a section, in which the voltage $V_{N1}$ is decreased, in other words, at a low voltage section, and the winding number ni is decreased at a section, in which the voltage $V_{N1}$ is increased, in other words, at a high voltage section, and the winding number ni is increased at a winding start side (a low voltage side), whereby the electric potential differences between the sections are set as a uniform electric potential difference, and the winding number can be secured, so that it can be suppressed that the ignition coil is capsized.

In a configuration which is indicated in FIG. 12, winding numbers n1, n2, n3, n4, n5, n6, and n7 of each of the sections are set as "n1>n2>n3>n4>n5>n6>n7".

As described above, the winding number per a section of the secondary coil is decreased while a winding is closed to a high voltage section, whereby a withstand voltage can be secured even when a very inclined electric potential distribution is set at the high voltage section.

In the scope of the present invention, it is possible that each of embodiments is freely combined, or each of embodiments is suitably modified or omitted.

DESCRIPTION OF THE SYMBOLS

"10" is a primary bobbin; "20," a primary winding; "30," a secondary bobbin; "40," a secondary winding; "50," an iron core; "60," an insulating case.

What is claimed is:

1. An ignition coil for an internal combustion engine, comprising:

a primary coil which includes a primary winding which is wound around a primary bobbin;

a secondary coil which is arranged at an outer circumference of the primary coil, and includes a secondary winding which is separately wound around a secondary bobbin which is coaxially arranged with respect to the primary coil and includes a plurality of sections, and supplies a high voltage to an ignition plug in accordance with an energization operation or a breaking operation of a primary electric current which is flowed to the primary winding;

an iron core by which the primary coil and the secondary coil are magnetically linked; and an insulating case in which the primary coil, the secondary coil, and the iron core are installed; wherein a winding portion of the secondary coil is configured in a state where a maximum winding height is set as 20% through 30% with respect to an axis length winding length.

2. An ignition coil for an internal combustion engine, as recited in claim 1, wherein a plurality of the sections, which are included in the secondary bobbin, are separated by using walls, and the walls between sections, which have many windings of the secondary coil, are thicker than the walls between sections which have few windings.

3. An ignition coil for an internal combustion engine, as recited in claim 1, wherein an internal diameter of the secondary winding is large and an outside shape is small at a section at a winding end side of the secondary coil in comparison with a section at a winding start side.

4. An ignition coil for an internal combustion engine, as recited in claim 1, wherein a winding number per a section of the secondary coil is decreased at a section at a winding end side in comparison with a section at a winding start side.

* * * * *